US005513786A

United States Patent [19]

Drane

[11] Patent Number: 5,513,786

[45] Date of Patent: May 7, 1996

[54] HANDS-FREE UMBRELLA HOLDER

[76] Inventor: Jerome Drane, 418 Meadow St., Agawam, Mass. 01001

[21] Appl. No.: 298,667

[22] Filed: Aug. 31, 1994

[51] Int. Cl.[6] ..... A45B 11/02

[52] U.S. Cl. ..... 224/188; 224/915; 224/605, 623, 674, 901.4, 626; 135/34.2

[58] Field of Search ..... 224/915, 250, 224/251, 252, 186–190, 202, 205, 206, 208; 135/34.2

[56] References Cited

U.S. PATENT DOCUMENTS

| | | | |
|---|---|---|---|
| 148,573 | 3/1874 | Moschcowitz | 135/34.2 |
| 858,527 | 7/1907 | Minor | 135/34.2 |
| 1,657,263 | 1/1928 | Lauby | 224/188 |
| 2,085,984 | 7/1937 | Kruithof | 224/188 |
| 3,379,201 | 4/1968 | Lynch | 135/34.2 |
| 3,891,174 | 6/1975 | Harvey | 224/250 |
| 4,537,339 | 8/1985 | Pearson | 224/188 |
| 4,819,845 | 4/1989 | Byrd | 224/250 |

FOREIGN PATENT DOCUMENTS

| | | | |
|---|---|---|---|
| 894903 | 10/1953 | Germany | 135/34.2 |
| 1236144 | 3/1967 | Germany | 224/190 |

*Primary Examiner*—Henry J. Recla
*Assistant Examiner*—Gregory M. Vidovich
*Attorney, Agent, or Firm*—McCormick, Paulding & Huber

[57] ABSTRACT

An umbrella holder which straps to an individual's torso is adapted to hold an open umbrella upright so as to permit the user's hands to be unencumbered. The umbrella holder includes a harness having a shoulder strap which crosses the back and chest of the user at an oblique angle and engages a waist belt. A support member which secures the umbrella to the harness extends generally perpendicular from the belt and engages the shoulder strap. The shoulder forms a brace which provides lateral support to the support member to maintain the umbrella in its upright orientation.

11 Claims, 2 Drawing Sheets

HANDS-FREE UMBRELLA HOLDER

FIELD OF THE INVENTION

This invention relates to a holder for umbrellas and more particularly to a hands-free umbrella holder that can be worn about an individual's torso.

BACKGROUND OF THE INVENTION

A number of patents disclose umbrella holders which secure opened umbrellas on the body so as to free both hands of the user. The umbrella holders disclosed in the prior art range from a complex mechanical device to a simple all of harness, which have some drawback.

U.S. Pat. Nos. 1,020,666; 1,466,715 and 4,537,339 disclose an umbrella holder having a large rigid device which secures the umbrella to a leather or metallic harness. These devices are quilt cumbersome and relatively complicated to use.

Other umbrella holders reduced the amount of hardware needed to support the umbrella by simply mounting a rigid pocket or tube to a harness. For example, U.S. Pat. No. 2,085,984 discloses an umbrella holder comprising an elongated pocket having a stiff backing plate maintained against the user's chest by two straps. The umbrella holder is relatively uncomfortable for the user because it requires placement of the upper strap under the shoulder. Another drawback is that the umbrella holder can only be used with an umbrella specifically manufactured to be used in conjunction therewith.

U.S. Pat. No. 3,700,149 also discloses an umbrella holder having a rigid holder fastened to a continuous strap which functions as both a belt and shoulder strap. Again, this holder is considered to be uncomfortable when in use because the shoulder strap passes under the user's shoulder. In addition, the placement and removal of the umbrella into and out of the holder is time-consuming and complex.

U.S. Pat. No. 1,657,263 discloses an umbrella holder comprising a harness lo with no tube or pocket to retain the umbrella. The handle and shaft of the umbrella is merely fastened to the harness at one point on the belt and another point on the shoulder strap. The rear portion of the shoulder strap crosses the user's back, however, the front portion extends over the shoulder and down the chest, generally perpendicular to the belt. The shoulder strap does not provide any lateral support to the umbrella, therefore the umbrella may have a tendency to pull the strap off the user's shoulder. Another disadvantage is that the shoulder strap does not have any adjustment so as to accommodate different size individuals.

SUMMARY OF THE INVENTION

Accordingly, it is an object the present invention to provide a highly effective, versatile, lightweight, and hands-free umbrella holder so conformable that when in use, it is comfortable when worn under an individual's jacket or outer clothing.

It is a further object to provide a simple to use hands-free umbrella holder.

It is another object to provide a hands-free umbrella holder that supports umbrellas having handles of various shape or size.

According to the present involution, the hands-free umbrella holder of this invention includes a waist belt which surrounds the user's upper torso, a support member that extends upward generally perpendicular therefrom adapted to secure the shaft of an opened umbrella in an upright position and a diagonal support or brace extending at an oblique angle from the belt to engage the upright support member at an upper portion thereof to provide lateral support therefor.

The above and other objects and advantages of this invention will become more readily apparent when the following description is read in conjunction with the accompanying drawings.

DETAILED DESCRIPTION OF THE PREFERRED EMBODIMENTS

Figure 1:
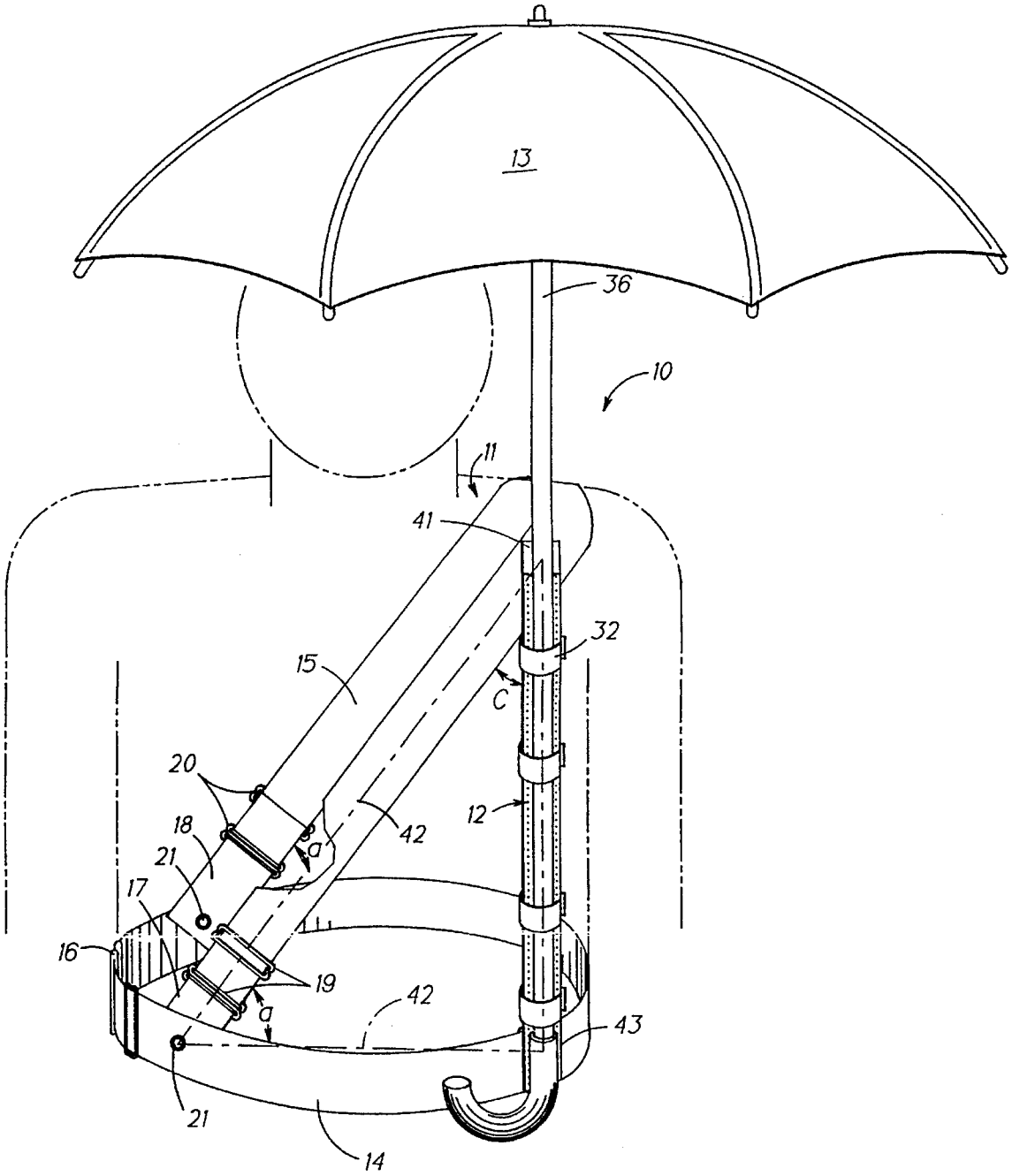
FIG. 1 is a perspective view of the preferred embodiment of the present invention disposed about the torso of a user, shown in phantom, with an umbrella having a hooked handle secured thereto.

Referring to FIG. 1, an umbrella holder 10 is shown having a harness 11 and a support member 12 secured thereto adapted to be worn about an individual's body to hold an opened umbrella 13 in a generally vertical or upright orientation, thereby freeing the individual's hands for other tasks. The harness 11 comprises a waist belt 14 and a shoulder strap 15 having a first end 17 and a second end 18 pivotably connected thereto. An upper portion 41 of the support member 12 is also pivotally secured to the shoulder strap 15 at a predetermined distance from the first end 17 thereof and the lower portion 43 of the support member is adjustably secured to the belt 14 to ensure the support member is maintained generally perpendicular to the belt.

The pivotal connection 21 between the belt and shoulder strap may be in the form of rivets, snaps, or similar fasteners. The shoulder strap 15 forms a diagonal truss or brace 42 at oblique angle a with the belt 14 and provides lateral support to the upper portion 41 of the support member to thereby maintain the umbrella 13, disposed therein, in an upright position and prevent it from slipping or moving outwardly from the user's shoulder.

The harness 11 is preferably fabricated of a flexible lightweight material, such as nylon webbing, to permit the umbrella holder 10 to be comfortably worn under one's jacket or outer clothing, therefore permitting the user to simply remove the umbrella 13 when moving indoors, while permitting the user to leave the harness comfortably in place until umbrella is needed again.

Figure 3:
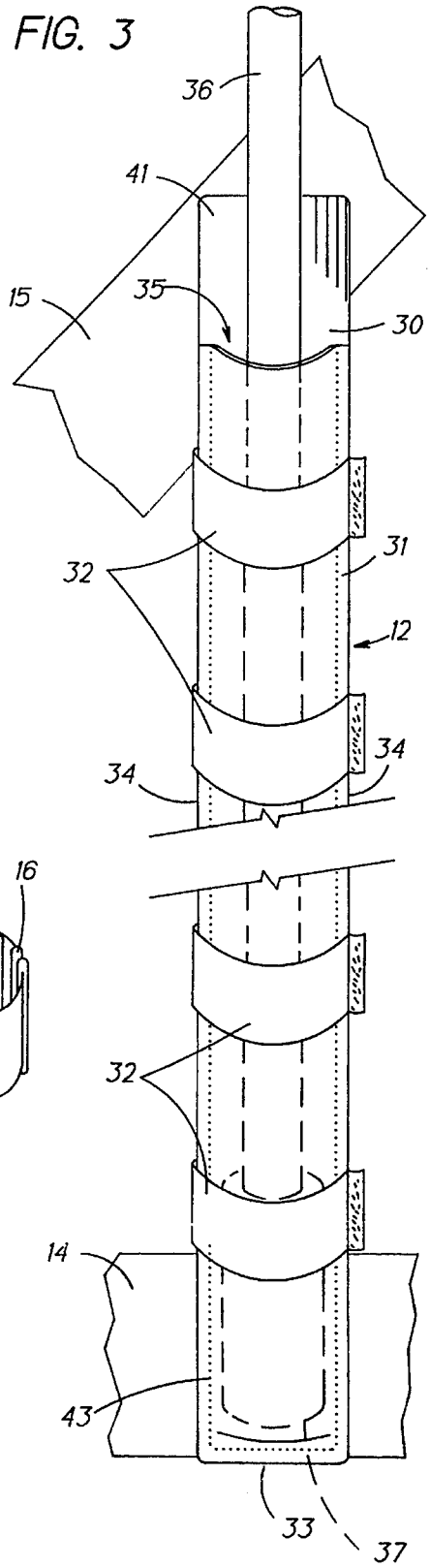
FIG. 3 is an enlarged front view of the support member of FIG. 2 shown with an umbrella having a cylindrical handle, partially in phantom, disposed therein.

Referring to FIG. 3, the support member 12 comprises a resiliently flexible backing strip 30 and a soft flexible material 31 which extends from one side 34 thereof to the other side and may be secured at the bottom edge 33 to form a sheath, pocket or scabbard 35 into which the shaft 36 and handle 37 of the umbrella 13 may be inserted and retained therein with the umbrella in an upright position in generally perpendicular relation to the belt 14. The backing strip 30 is preferably formed of a soft and flexible material, such as polymeric material, so that when the umbrella shaft is not disposed therein, the support member will be characterized by its ability to conform readily and comfortably to the body of the user. On the other hand, the support member is sufficiently form-stable so that when the umbrella shaft is inserted into the sheath, defined in part by the support member, it is capable of supporting the umbrella 13 in an upright orientation, as shown in FIG. 1. The flexible material 31 is preferably of an elastic-type fabric, such as that sold under the trademark LYCRA™, to be snugly stretched to accommodate umbrella handles of varying sizes and shapes.

Figure 2:
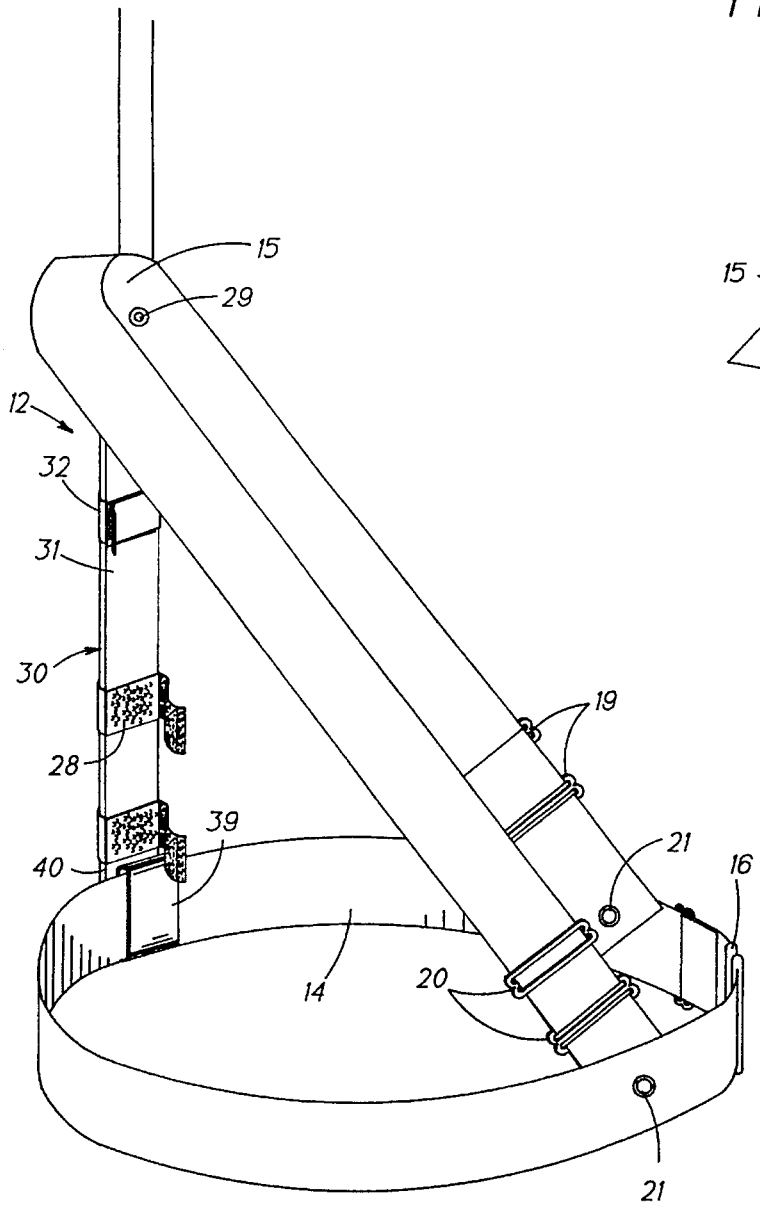
FIG. 2 is a rear perspective view of the preferred embodiment of the present invention of FIG. 1.

In addition, the support member 12, in the preferred embodiment, has a plurality of strap type fasteners 32, spaced along the length thereof, with a plurality of Velcro type fasteners 28 (see FIG. 2) or the like disposed on the back of the support member. The strap type fasteners 32 permit an umbrella 13 to be easily secured to the umbrella holder 10 by simply placing the shaft 36 and handle 37 of the umbrella on the outer surface of the scabbard 35 by securely wrapping the strap type fasteners therearound and then fastening, the strap to the velcro strips 28, as best shown in FIG. 2. The straps 32 may also securely hold the umbrella handle and shaft that is fitted within the scabbard 35 in an upright position, as shown in FIG. 1, especially umbrellas having a short shaft.

Referring to FIG. 2, the support member 12 slidably engages the belt 14 to permit the user to laterally adjust the support member along the belt to a generally upright or slightly tilted position. The means to secure the support member 12 to the belt 14 may be in the form of a clip (not shown) or loop 39, as shown in FIG. 2, secured to surface 40 thereof. The upper portion 41 of the support member is pivotally secured to the shoulder strap 15 by a rivet, snap, or similar fastener 29 (see FIG. 2) to the shoulder strap 15 which permits adjustment of the angle c (shown in FIG. 1) to adapt the harness 11 to a wide range of users and thereby prevent binding or twisting of the shoulder strap.

When the harness 11 is donned by an individual, the belt 14 is secured about the user's waist by a conventional belt buckle 16 which also adjusts the tightness thereof about the user's waist. The belt buckle 16 is disposed on the side of the user's body so that the shoulder strap 15 extends diagonally, at substantially oblique angle a, across the chest over the shoulder opposite the belt buckle and diagonally across the back of the user and the support member 12 is disposed over the shoulder opposite the belt buckle as shown in FIG. 1. Adjusting means 20 disposed between the second end 18 of the shoulder strap 15 and the point where the support member 12 engages the shoulder strap, is disposed on the shoulder strap 15 to allow adjustment of the strap length depending upon the user's upper body size. Adjusting means 19, disposed between the first end 17 of the shoulder strap 15 and the point where the support member 12 engages the strap, laterally adjusts the position of the support member on the user's torso to ensure that it is disposed on the shoulder opposite the belt buckle 16.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what will be claimed is:

1. An umbrella holder adapted to be disposed about a user's upper torso to support an umbrella having a shaft and a handle in an opened and generally upright orientation thereby freeing the user's hands, comprising a waist belt for encircling the user's waist, a support member having a lower portion securable to said belt and adapted to extend upward, generally perpendicular to said belt and to receive the shaft of the umbrella, and a strap having opposing end portions securable to said belt and; adapted to extend from said belt diagonally across the chest and back and over the user's shoulder, said strap secured to an upper portion of said support member adjacent the user's shoulder, said support member comprising a backing strip formed of resiliently, flexible, form-stable material adapted to extend upwardly from said waist belt to said strap and a flexible sheet material adapted to extend across a surface of the backing strip substantially along the length thereof and secured along side and bottom edges of the backing strip to form a scabbard having an open upper end adapted to receive therein the handle and shaft of the umbrella in axial alignment therein.

2. An umbrella holder as in claim 1, wherein the upper portion of said backing strip and the lower portion thereof are disposed in surface-to-surface contact with said shoulder strap and waist belt, respectively, and secured thereto.

3. An umbrella holder as in claim 2, wherein said support member has affixed thereto at least one fastening means at one end thereof for forming a loop over the umbrella shaft to further retain the shaft in upright relation to the belt and shoulder strap.

4. An umbrella holder as in claim 3, wherein said fastening means includes an adhesive strip.

5. An umbrella holder as in claim 4, wherein said sheet material is formed of flexible elastic-type material.

6. An umbrella holder as in claim 5, wherein said support member engages the belt by a slidable means affixed thereto to permit lateral adjustment thereof.

7. An umbrella holder as in claim 1, wherein said belt has a belt buckle adapted to fasten and adjust said belt about the user's waist.

8. An umbrella holder as in claim 7, wherein said belt is fabricated of a lightweight, flexible material.

9. An umbrella holder as in claim 1, wherein said strap has an adjusting means, disposed between a first end therefor and said support member, adapted to adjust the length thereof.

10. An umbrella holder as in claim 9, wherein said strap has an adjusting means, disposed between a second end thereof and said support member, to laterally adjust the same about the user's torso.

11. An umbrella holder as in claim 10, wherein said strap is fabricated of lightweight, flexible material.

* * * * *